US005431030A

United States Patent [19]

Ishizaki et al.

[11] Patent Number: 5,431,030

[45] Date of Patent: Jul. 11, 1995

[54] GARMENTS HAVING KNITTED CONSTRUCTION OF VARIABLE GAUGE AND DENSITY

[75] Inventors: Yoshiyuki Ishizaki, Kyoto; Hideo Okuyama, Hyogo, both of Japan

[73] Assignee: Wacoal Corp., Kyoto, Japan

[21] Appl. No.: 153,991

[22] Filed: Nov. 18, 1993

[30] Foreign Application Priority Data

Nov. 24, 1992 [JP] Japan ..... 4-313789

[51] Int. Cl.[6] ..... A41B 9/06

[52] U.S. Cl. ..... 66/176; 2/69; 2/243.1

[58] Field of Search ..... 2/243.1, 90, 69, 239, 2/409; 66/170, 171, 176, 172 E, 178 A; 450/115, 116, 117, 118, 124, 125, 126, 19, 20, 21, 74, 75, 76

[56] References Cited

U.S. PATENT DOCUMENTS

| | | | |
|---|---|---|---|
| 672,028 | 4/1901 | Appleton | 2/92 |
| 991,777 | 5/1911 | Goodman | 66/171 |
| 2,259,537 | 10/1941 | Wengen | 66/171 |
| 3,224,231 | 12/1965 | Matz . | |
| 3,413,824 | 12/1968 | Kuney . | |
| 4,698,847 | 10/1987 | Yoshihara . | |

FOREIGN PATENT DOCUMENTS

| | | |
|---|---|---|
| 346179 | 1/1905 | France . |
| 2410368 | 9/1975 | Germany . |
| 61-124611 | 6/1986 | Japan . |
| 61-239002 | 10/1986 | Japan . |
| 440445 | 7/1992 | Japan . |
| 577761 | 10/1993 | Japan . |
| 2013740 | 8/1979 | United Kingdom . |

*Primary Examiner*—Andrew M. Falik
*Assistant Examiner*—Gloria Hale
*Attorney, Agent, or Firm*—Merchant, Gould, Smith, Edell, Welter & Schmidt

[57] ABSTRACT

A garment with sleeves comprising a stretchable, knitted fabric, wherein an underbust area of the garment comprises a high-gauge knitting with relatively high density, shoulders and upper back area of the garment comprise a low-gauge knitting with relatively low density, and cuff areas of the garment comprise a medium-gauge knitting with relatively medium density.

9 Claims, 9 Drawing Sheets

FIG. 6B
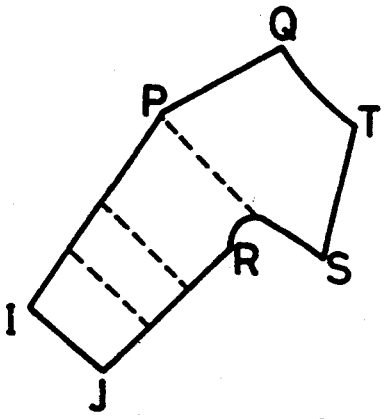
FIG. 6C
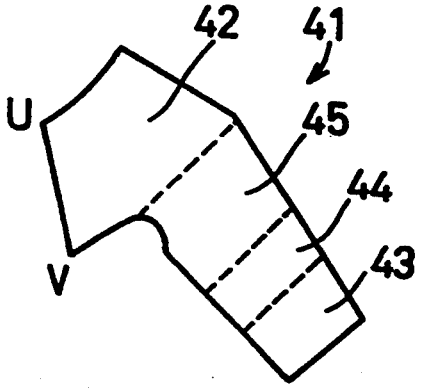
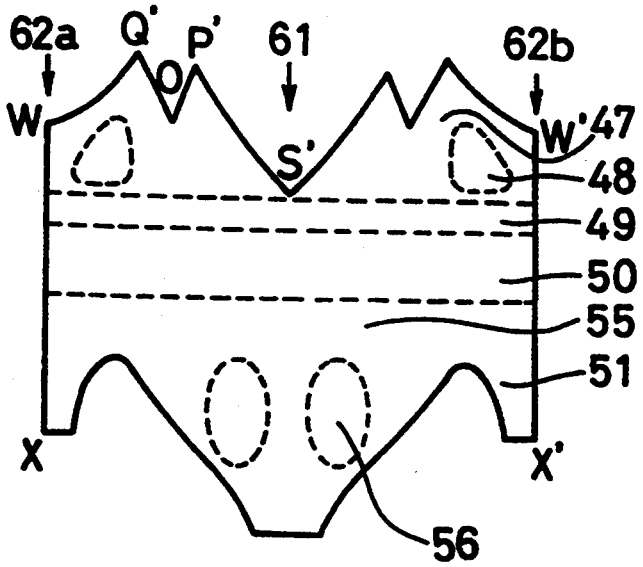
FIG. 6A

GARMENTS HAVING KNITTED CONSTRUCTION OF VARIABLE GAUGE AND DENSITY

BACKGROUND OF THE INVENTION

1. Field of the Invention

The present invention relates to garments with sleeves, and, more specifically, to garments with sleeves with excellent flexibility being able to follow the physical action of the human body.

2. Description of the Prior Art

Conventionally, garments comprising a stretchable knitted fabric are popular since they are easy to put on and to take off, have a comparatively good fit to the body, and allow comparatively easy movement allowed for the body without significant resistance while they are worn because of good elasticity. Consequently, they are used extensively in undergarments, which often include circular knitted fabric. In addition, the stretchable knitted fabric is applied to garments such as day wears, leotards, sportswear, blouses, coats, blousons, jumpers, and the like.

FIG. 11 shows schematically a front view of an undergarment with long-sleeves and a groin piece as a typical example of conventional garments comprising a stretchable knitted fabric.

In the example shown in FIG. 11, the undergarment is made of circular knitted fabric, and the body 201, continuously integrating the breast, back, waist, abdomen, and hip areas in one unit, is sewn and joined with sleeves 200 made of the same circular knitted fabric at the seams 205; it also possesses a groin piece (a crotch) 203, which is designed to be opened and closed with suitable fasteners 204, such as grippers, hooks, zippers, or Hook-and-Loop fasteners attached to the groin piece 203. Numeral 202 shows a leghole (an opening for a leg).

In the conventional garments comprising a stretchable knitted fabric as shown in FIG. 11 for an example, the gauge of the knitted fabric is nearly uniform in all the portions, such as the breast,, back, waist, abdomen and hip areas as well as sleeves 200. That is, in the conventional garments comprising the stretchable knitted fabric, no specific gauge-changing is intentionally adopted.

Now, in the context of the present invention, physical action does not always mean special exercise such as sports, but includes physical motion which is frequently repeated in ordinary daily life, such as bending forward and stretching out the hand to take a thing located in front of the person, raising the hand upward to take a thing located above, rotating the neck or body to look backward or look aside, or leaning backward while lightly stretching the body to feel refreshed (stretching and leaning the body backward), or rotating or bending arms at joints of shoulders and elbows.

When the physical action which is frequently performed in ordinary daily activities as mentioned above is performed, in the case of the conventional garments comprising the stretchable knitted fabric, sleeves 200 gradually slide up toward the shoulder, causing a problem by generating a considerably large number of wrinkles in the sleeves, at the shoulders, or at the sides, or a problem in that a side edge of the leghole is likely to rise. Even in the case of garments for the upper body, which have no abdomen, hip and groin piece areas, nearly the same problems occur, except for the rising at the side edges of the leghole areas. In addition, in such garments for the upper body, the waist area and the hem of a body part tend to be raised upward or generate wrinkles. These wrinkles are ugly for outer garments, and in the case of underwear, they cause wear-discomfort. Even if the wearer wants to straighten it up, it is difficult to do in public, because wearer should take off her outergarment, and these wrinkles are reflected to the outer garments, adversely affecting the appearance of wearer.

These problems in the conventional garments are attributed primarily to the physical motion of the human body as described above, particularly, the motion from shoulder to upper back performed frequently in daily activities, but it is also attributed to the failure to have taken specific corrective measures against these problems.

SUMMARY OF THE INVENTION

It is the object of the present invention to provide garments (which improve the above-mentioned defects of conventional garments,) i.e. which provide less wrinkles and rising due to physical motion in daily activities, and excellent flexibility as well as excellent wear comfort.

To achieve the above object, the present invention relates to a garment comprising a stretchable knitted fabric, the garment comprising:

sleeves provided with a cuff area;

a breast area;

an underbust area;

shoulder areas; and an upper back area;

wherein the underbust area comprises a high-gauge knitting with relatively high density, the shoulder and upper back areas comprise a low-gauge knitting with relatively low density and the cuff areas comprise a medium-gauge knitting with relatively medium density.

It is preferred that in the above-mentioned garments of the present invention, a breast area of the garments comprises a medium-gauge knitting with relatively medium density and bust areas in the breast area comprise a low-gauge knitting with relatively low density.

It is also preferred that in the above-mentioned garments of the present invention, the sleeves of the garments comprising a stretchable knitted fabric are long sleeves, wherein the vicinities of the elbow joints of the sleeves comprise a low-gauge knitting with relatively low density.

It is also preferred that in the above-mentioned garments of the present invention, a waist area of the garments comprises a medium-gauge knitting with relatively medium density.

It is also preferred that in the above-mentioned garments of the present invention, the garments with sleeves further has abdomen and hip areas formed continuously integral with the body area, and the abdomen and hip areas comprise a high-gauge knitting with relatively high density.

It is also preferred that in .the above-mentioned garments of the present invention, the vicinities of bulge parts in the hip area comprise a low-gauge knitting with relatively low density.

It is also preferred that in the above-mentioned garments of the present invention, one of the sleeves, one of shoulder areas and one of upper back areas are formed from a continuous fabric.

It is also preferred that in the above-mentioned garments of the present invention, the stretchable knitted fabric is a circular knitted fabric.

It is also preferred that in the above-mentioned garments of the present invention, the stretchable knitted fabric which forms garments is a stretchable knitted fabric comprising fibers containing elastomer fibers.

In the garments with sleeves of the present invention comprising the stretchable knitted fabric, the underbust area of the garments comprises a high-gauge knitting with relatively high density. The shoulder and upper back area of the garments comprise a low-gauge knitting with relatively low density and the cuff areas of the garments comprise a medium-gauge knitting with relatively medium density. Providing the shoulder and upper back area with a low-gauge knitting allows the shoulder and upper back area to stretch not only longitudinally as well as laterally but also diagonally with comparatively low tension, ensuring good flexibility and freedom of cramp at the shoulder .and upper back area. Consequently, even if large tension is not provided, the sleeves comprising the medium-gauge knitting can be fitted with a proper compressive force. Even if the underbust area is formed by the high-gauge knitting with strong tension, the wearer does not feel discomfort because the underbust area is located at a position corresponding to the wearer's ribs, and the garments can be firmly supported to prevent wrinkles being generated in the shoulder and upper back area by rising of the breast area. As a result, garments with good wear comfort with less wrinkle generation as a whole and having excellent flexibility can be provided.

In the above-mentioned garments of the present invention, according to a preferable embodiment of the present invention the breast area of the garments comprises the medium-gauge knitting with relatively medium density and the bust areas in the breast area of the garments comprises the low-gauge knitting with relatively low density. Thus the shape of the breast is adjusted with proper tension generated by medium-gauge knitting, and an attractive bust line is attained without flattening the bust by forming the bust area with sufficiently stretchable ion-gauge knitting.

In the above-mentioned garments of the present invention, according to a preferable embodiment of the present invention the sleeves of the garments made of a stretchable knitted fabric are long sleeves and the vicinities of the elbow joints of the sleeves comprise a low-gauge knitting with relatively low density which brings easy stretching with relatively low tension. This provides good flexibility for bending of elbow joints and further prevents the sleeves from being raised and generating of wrinkles.

In the above-mentioned garments of the present invention, according to a preferable embodiment of the present invention the waist area of the garments comprises the medium-gauge knitting with relatively medium density, which brings the tension to the medium level. This gives a comfortable fitting feeling with a proper supporting force of the waist area, prevents the waist area from being raised, and reduces wrinkle generation. Because the tension at the underbust area is increased to prevent rising generated by motion of the shoulders, upper back and arms, the tension at the waist area can be kept to a desirable medium level and wear comfort is ensured.

In the above-mentioned garments of the present invention, according to a preferable embodiment of the present invention the garments with sleeves made of stretchable knitted fabric further have abdomen and hip areas formed continuously integral with the body area and the abdomen and hip areas comprise the high-gauge knitting with relatively high density which increase tension at the abdomen and hip areas. Thus, rising of the fabric is prevented and wrinkle generation is reduced and rising of the side edges of legholes is also prevented and any possible discomfort is reduced. This also functions to control the body profile to a more beautiful appearance, by suppressing any superflous flesh from swelling out in the abdomen region and keeping the bulges of the hip in a high position.

In the above-mentioned garments of the present invention, according to a preferable embodiment of the present invention the vicinities of the bulges of the hip comprise a low-gauge knitting with relatively low density. Thus two round top parts of the hip are not flattened, but a natural round hip profile along the vicinities of the tops of the bulges of hip is kept, since the tension near the top parts of the hip is decreased.

In the above-mentioned garments of the present invention, according to a preferable embodiment of the present invention one of the sleeves and one of the shoulders areas and one of the upper back areas are formed from the continuous integrated fabric. This allows the garment to follow expansion and contraction in the moving direction more successfully with a small stress, due to the low-gauge knitting at the shoulder and upperback areas, thereby preventing wrinkle generation or rising of sleeves more effectively.

In the above-mentioned garments of the present invention, according to a preferable embodiment of the present invention circular knitted fabric is used as the stretchable knitted fabric. Thus, the sewn portions are reduced and adjustment of the gauge of the knitting to a desired level is easy, and cost increases can be suppressed.

In the above-mentioned garments of the present invention, according to a preferable embodiment of the present invention the stretchable knitted fabric of the garments comprises fibers containing elastomer fibers. This increases stretchability not only of the knitting structure but also of the material of the fiber, helping the fabric to display the suitable tension more easily and making the garments more wear-comfortable.

BRIEF DESCRIPTION OF THE DRAWINGS

FIG. 6 illustrates the development of the components of the woman's undergarment shown in FIGS. 4 and 5 before sewing.

DETAILED DESCRIPTION OF THE INVENTION

Figure 1:
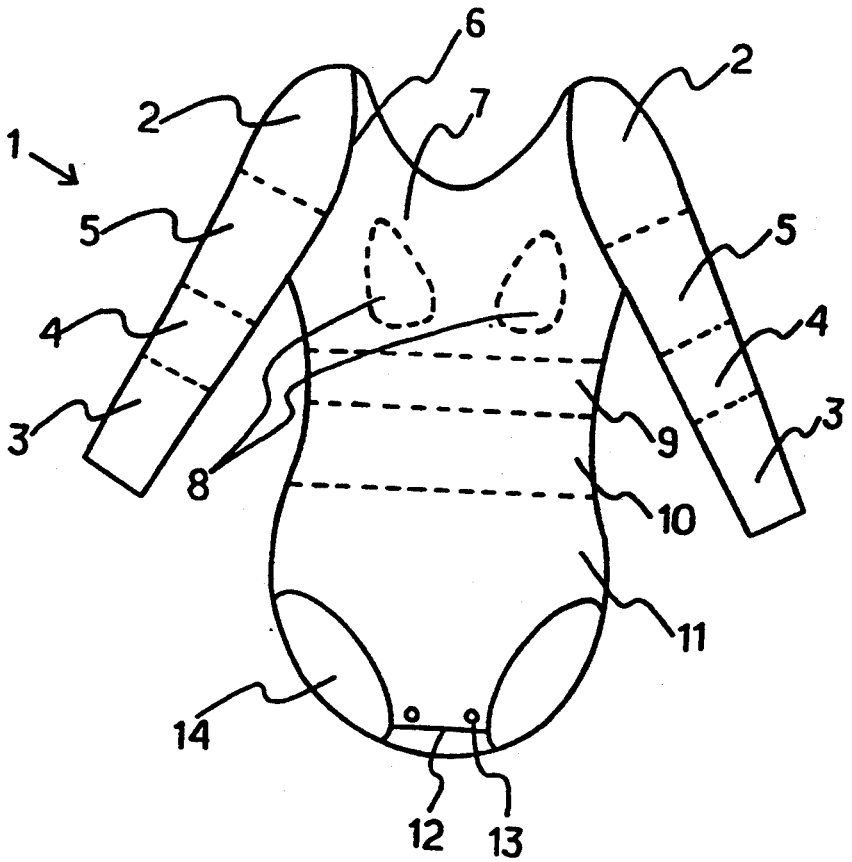
FIG. 1 is a schematic front view of a woman's long-sleeved undergarment with the groin piece as one embodiment of the garments of the present invention.

Referring now to the drawings, examples of the garments according to the present invention will be described in detail hereinafter, but the invention is not limited to these examples only.

Figure 2:
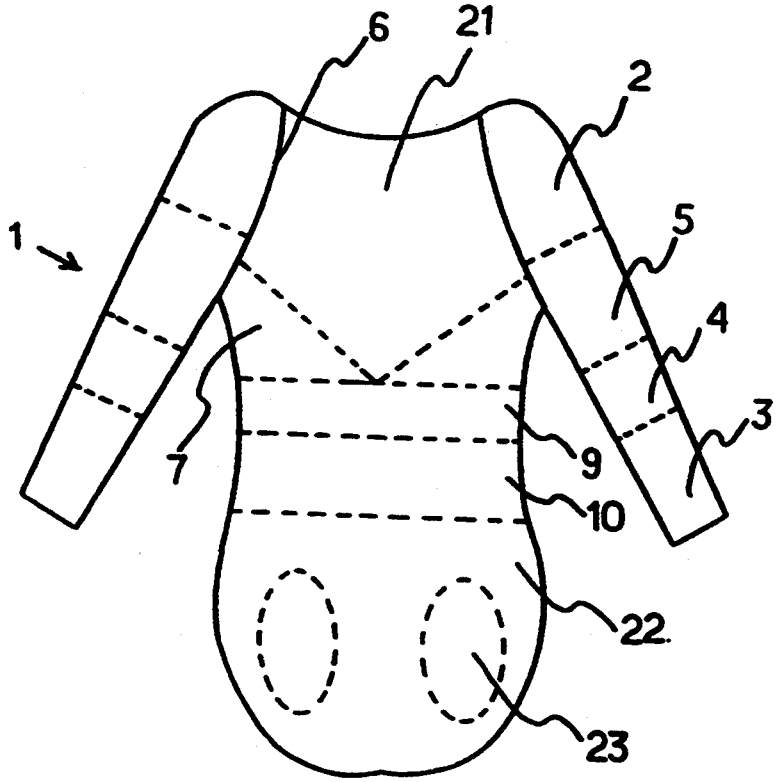
FIG. 2 is a schematic rear view of the woman's undergarment of FIG. 1 as seen from the back.
Figure 3A:
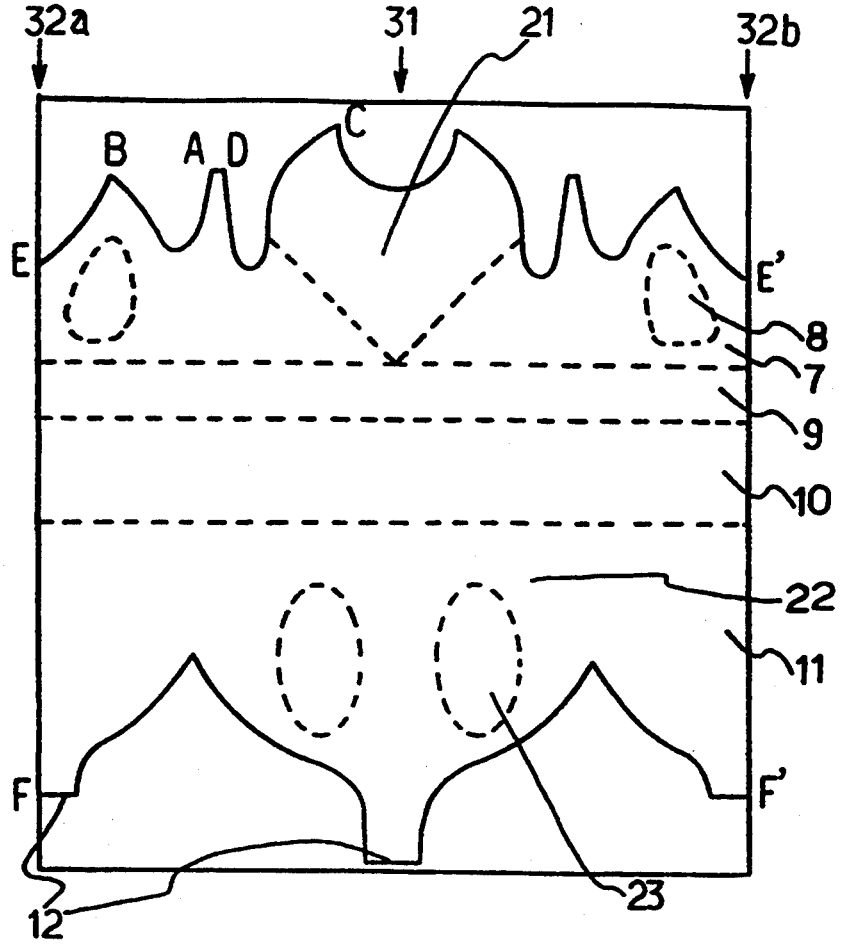
FIG. 3 illustrates the development of the components of the woman's undergarment shown in FIGS. 1 and 2 before sewing.
Figure 3B:
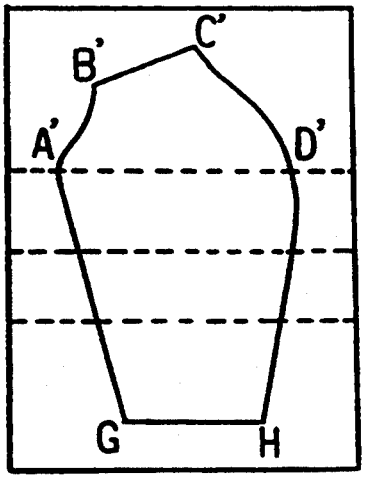
Figure 3C:
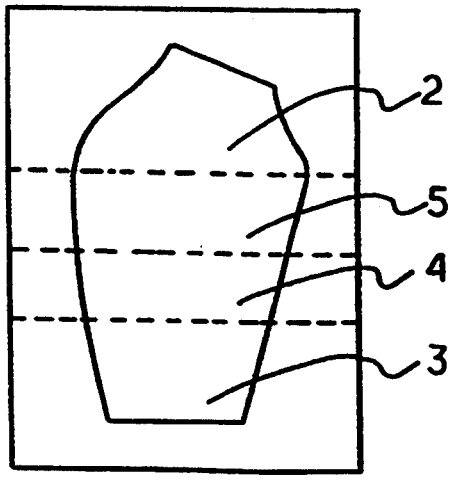

Referring to FIGS. 1–3, this undergarment comprises a stretchable knit fabric. In FIGS. 1 through 3, numeral 1 is a sleeve, and in this example, the end part of the sleeve 3 and the upper part of the sleeve 5 comprise a medium-gauge knitting, and therefore, the tension is adjusted to the medium level. The vicinity of the elbow joint 4 at the middle of the end part of the sleeve 3 and the upper part of the sleeve 5 comprises a low-gauge knitting, and consequently, the tension of the knitted fabric near the elbow joint is reduced, allowing the fabric to be stretched and contracted comparatively easily with a small force. The shoulder areas 2 comprise a low-gauge knitting, and consequently, the tension of the knitted fabric of the shoulder areas is reduced, allowing the fabric to be stretched and contracted comparatively easily with a small force. The same applies to the upper back 21. The breast area 7 comprises a medium-gauge knitting, and consequently, the tension is adjusted to the medium level, but in addition, the bust areas 8 in the breast area 7 comprises a low-gauge knitting, and an attractive appearance of the bust can be attained without flattening the bust, since the low-gauge knitting has good stretchability. It is preferable that in particular, the bust areas 8 are knitted in ups and downs three-dimensionally, taking account of the bust volume.

The underbust area 9 comprises a high-gauge knitting which provides strong tension. Thus it is firmly supported to prevent generation of wrinkles at the shoulders 2 and upper back 21 by rising of the breast area 7.

The waist area 10 comprises a medium-gauge knitting. Controlling the tension to the medium level can give a comfortable fitting feeling by the proper supporting force of the waist area 10, prevent the waist area from being raised, and minimize wrinkle generation. Because rising of the undergarment due to movement of the shoulders, upper back, and arms has already been prevented by increasing the tension at the underbust area 9, the tension at the waist area can be controlled to the desired medium level, achieving the condition in which the waist does not have to be excessively tightened and near comfort is not compromised.

The abdomen area 11 and hip area 22 comprise a high-gauge knitting. Increasing the tension at the abdomen area 11 and hip area 22 can prevent rising of the undergarment and reduces wrinkle generation as well as preventing rising of the side edges of legholes 14, thereby avoiding any discomfort for the nearer. The superflous flesh is constrained from swelling in the abdomen area and the bulges of hip are maintained in a high position, and the shape of body can be adjusted beautifully. The vicinities of the two round tops 23 of the hip 22, that is, the vicinities of the bulge portions 23 of hip, are formed with a low-gauge knitting and the tension near the tops 23 of the hip is reduced. Thus the round shape of the tops 23 are not flattened, and a natural round appearance along the vicinities of the tops of the hip are maintained.

The groin peice 12 is formed with the lower portion of the abdomen area 11 and the portion extending from the tip end of the hip 22. The grippers, hooks, zippers, Hook-and-Loop fastener, or other fastener 13 mounted to the groin peice 12 enable the groin piece 12 to be opened and closed. Numeral 14 is the leghole through which a leg comes out.

In FIGS. 1 and 2, numeral 6 is the seam line which joins the sleeve 1 to the body.

The design as described above can provide an undergarment which has excellent flexible capabilities to follow physical action of human body, reduces generation of wrinkles, is free from rising, and provides excellent wear comfort.

FIG. 3 illustrates the development of the components of the woman's undergarment shown in FIGS. 1 and 2 before sewing.

In FIG. 3, (a) is the fabric for the front and back bodies, (b) is the fabric for the left sleeve, and (c) is the fabric for the right sleeve. In this example, a nearly square fabric is used and the solid lines shown in the drawing are the cutting lines for the bodies and sleeves. However, the front center 32*a* and 32*b* shown in FIG. 3 (a) are not cut because this fabric is circular knitted fabric and are connected at this portion to each other, and thus this fabric has a cylindrical form. In this development, the same symbols are assigned to the same portions in FIGS. 1 and 2 and the repeated description of the symbols will be omitted.

To obtain these fabrics, a knitting machine which can knit an optional portion in optional gauge (density) is selected from commercially available circular knitting machines such as a plain stitch circular knitting machine (for example, a plain stitch circular knitting machine that can adjust gauges from small density to large density in 31 steps). Using such a knitting machine, commands to achieve a specified gauge (density) at a specified portion are entered into the computer command input unit and knitted fabric with specified portions knitted into a specified gauge can be easily obtained. Almost all of these types of knitting machines employ a system to knit the portion with small density in coarse loops and to knit the portion with large density in small loops, but the present invention shall not be limited to these types of knitting machines only. In this type of knitting machine, the needles move as specified by the commands in accordance with the gauge patterns inputted in advance in such a manner that the fabric is knitted with loops in a specified density when a specified needle knits the specified number of courses, and therefore, the gauge can be freely set to any kind of pattern.

In FIG. 3, sleeves are attached to body by sewing the A'-B' line of left sleeve fabric (b) on the A-B line of the front and back body fabric (a), and the C'-D' line on the C-D line. To attach the right-sleeve fabric (c) to the front and back body fabric (a), the same applies only with the right and left changed. To make sleeves into a cylindrical form, in (b) of FIG. 3, the A'-G line is joined with D'-H line by sewing. The same is carried out for the fabric (c) for the right sleeve. In this way, the undergarment of the present invention shown in FIGS. 1 and 2 can be easily produced.

Next, referring to FIGS. 4 through 6, a further example of the long-sleeved woman's undergarment with the groin piece according to the present invention will be described in detail hereinafter.

Figure 4:
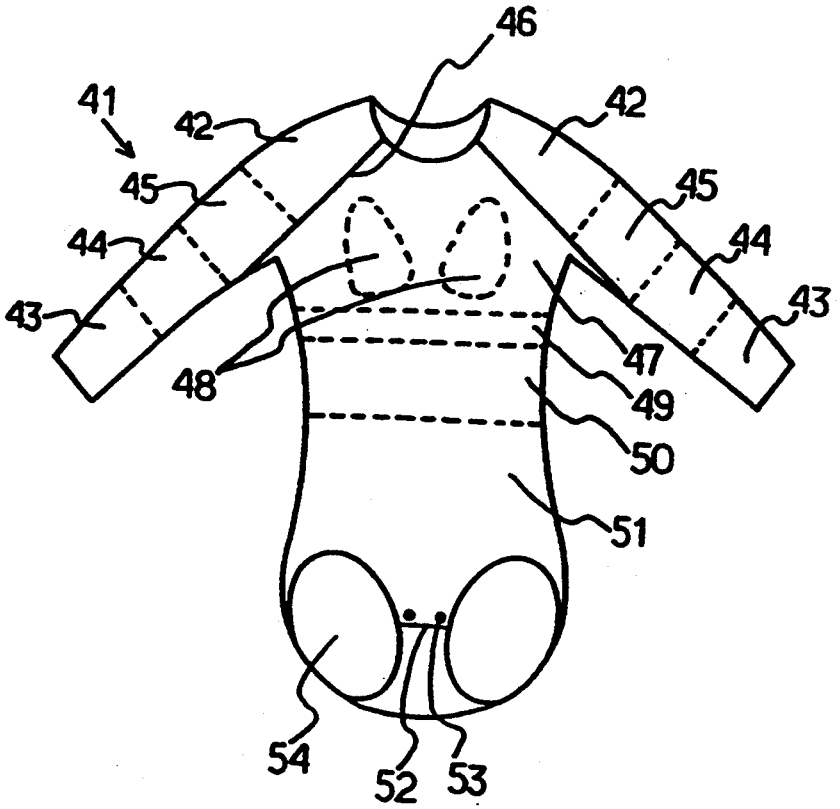
FIG. 4 is a schematic :front view of a woman's long-sleeved undergarment with the groin piece as another embodiment of the garments of the present invention.

FIG. 4 is a schematic front view of woman's long-sleeved undergarment with the groin piece as another embodiment of the garments of the present invention. FIG. 5 is a schematic rear view of the woman's undergarment of FIG. 4 as seen from the back. FIG. 6 illustrates the development of the components of the woman's undergarment shown in FIGS. 4 and 5 before sewing.

This undergarment also comprises a stretchable knitted fabric such as the circular knitted fabric.

Figure 5:
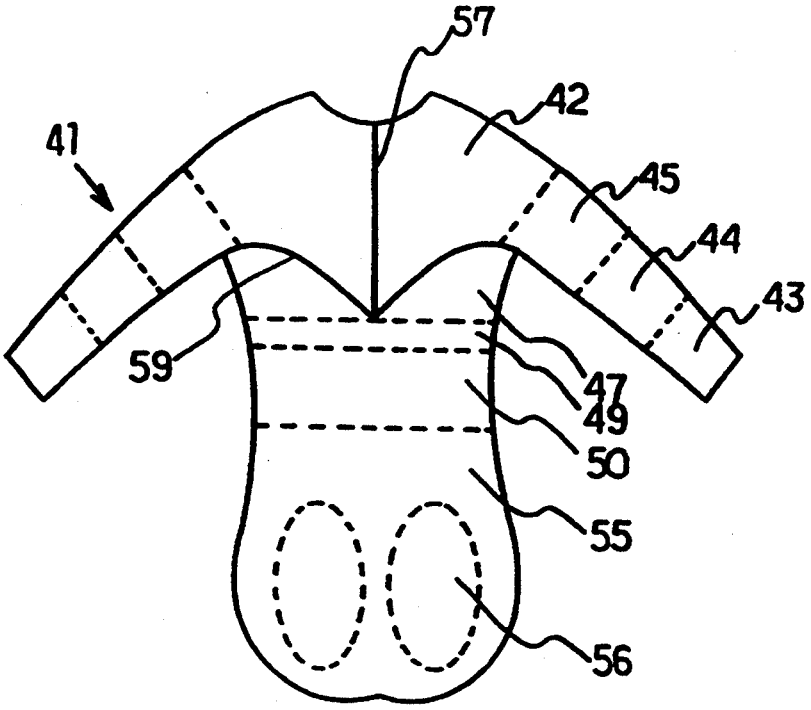
FIG. 5 is a schematic rear view of the woman's undergarment of FIG. 4 as seen from the back.

In FIGS. 4 through 6, numeral 41 is a sleeve, and in this example, the end part of the sleeve 43 and the upper part of the sleeve 45, which are main parts of the sleeve, comprise a medium-gauge knitting, and therefore, the tension is adjusted to the medium level. The vicinity of the elbow joint 44 at the middle of the end part of the sleeve 43 and the upper part of the sleeve 45 comprises a low-gauge knitting, and consequently, the tension of the knitted fabric near the elbow joint is reduced, allowing the fabric to be stretched and contracted comparatively easily with a small force. In this example, the shoulder area and upper back area 42 are formed with fabric continuously integral with the sleeve fabric. These areas comprise a low-gauge knitting. Consequently, tension is small and these areas can be stretched and contracted comparatively freely with a small force. Because the shoulder and upper back areas 42 are formed with continuous integral fabric, these areas are elastic and can be stretched or contracted more easily in accordance with stress than the garments; shown in FIGS. 1 through 3. This is one of the excellent features of this embodiment.

The breast area 47 comprises a medium-gauge knitting, and consequently, the tension is adjusted to the medium level, but in addition, the bust areas 48 in the breast area 47 comprises a low-gauge knitting, and the low-gauge knitting with good stretchability gives an attractive appearance to the bust without flattening the bust. It is preferable that in particular, the bust areas 48 be knitted in ups and downs three-dimensionally taking account of the bust volume.

The underbust area 49 comprises a high-gauge knitting which provides strong tension. Thus it is firmly supported to prevent generation of wrinkles at the shoulders and upper back areas 42 by rising of the breast area 47.

The waist area 50 comprises a medium-gauge knitting. Controlling the tension to the medium level can give comfortable fitting feeling by the proper supporting force of the waist area 50, prevent the waist area from being raised, and minimize wrinkle generation. Because rising of the undergarment due to movement of the shoulders, upper back, and arms has already been prevented by increasing the tension at the underbust area 49, the tension at the waist area cart be controlled to the desired medium level, achieving the condition in which the waist does not have to be excessively tightened and wear comfort is not compromised.

The abdomen area 51 and hip area 55 comprise a high-gauge knitting. Increasing the tension at the abdomen area 51 and hip area 55 can prevent rising of the undergarment and reduces wrinkle generation as well as preventing rising of the side edges of legholes 54, thereby avoiding any discomfort for the wearer. The superflous flesh is constrained from swelling in the abdomen area and the bulges of hip are maintained in a high position, and the shape of body can be adjusted beautifully. The vicinities of the two tops 56 of the hip 55, that is, the vicinities of the bulge portions of hip 55 is formed with a low-gauge knitting and the tension near the tops 56 of the hip is reduced, Thus the round shapes of the tops 56 are not flattened, and a natural round appearance along the vicinities of the tops of the hip are maintained.

The groin peice 52 is formed with the lower portion of the abdomen area 51 and the portion extending from the tip end of the hip 55. The grippers, hooks, zippers, Hook-and-Loop fastener, or other fasteners 53 mounted to the groin peice 52 enable the groin peice 52 to be opened and closed. Numeral 54 is the leghole through which a leg comes out.

In FIGS. 4 and 5, numerals 46, 59 are the seam line which joins the sleeve 41 to the body. In FIG. 5, numeral 57 is the seam line which joins the right and left shoulders and upper back area 42 together at the back center.

The design as described above can provide an undergarment which has excellent flexible capabilities to follow physical action of human body, reduces generation of wrinkles, is free from rising, and provides excellent wear comfort.

FIG. 6 illustrates the development of the components of the woman's undergarment shown in FIGS. 4 and 5 before sewing. In this case, unlike FIG. 3, they are shown in the state in which they are already cut into specified shapes.

In FIG. 6, (a) is the fabric for front and back bodies, (b) the fabric for the left sleeve, and (c) the fabric for the right sleeve.

However, the front center **62*a* and 62*b* shown in FIG. 6 (a) are not cut because this fabric is a circular knitted fabric, and are connected at this portion with each other. Thus this fabric has a cylindrical form. That is, the W-X line and W'-X' line of (a) of FIG. 6** are continuously connected into one.

In this development, the same symbols are assigned to the same portions in FIGS. 4 and 5 and the repeated description of the symbols will be omitted.

These fabrics with gauge adjusted to a specified gauge at each portion can be easily produced by circular knitting machines and the like described previously.

In FIG. 6, sleeves are attached to body by sewing the P-Q line of left sleeve fabric (b) on the P'-O-Q' line of the front and back body fabric (a) and the S-R line on the S'-P' line. To attach the right-sleeve fabric (c) to the front and back body fabric (a), the same applies only with the right and left changed. And at the back center, the T-S line of (b) in FIG. 6 is sewn together with U-V line of (c) in FIG. 6. This corresponds to the portion shown by the sewing line 57 in FIG. 5. To make the sleeve into a cylindrical form, the P-I line of (b) in FIG. 6 is joined together with the R-J line by sewing. The same is carried out for the right sleeve. In this way, the undergarment of the present invention shown in FIGS. 4 and 5 can be easily produced.

Figure 7:
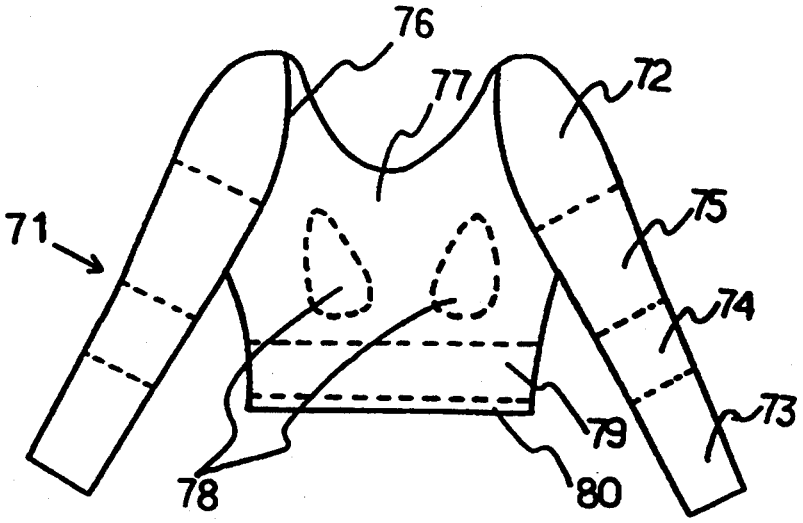
FIG. 7 is a schematic front view of a woman's long-sleeved undergarment with a short body length as one embodiment of the garments of the present invention.

FIG. 7 is a schematic front view of a woman's long-sleeved undergarment with a short body length for one embodiment of the garments of the present invention.

This undergarment is also made of stretchable knitted fabric such as the circular knitted fabric.

In FIG. 7, numeral 71 is a sleeve, and in this embodiment, the end part of the sleeve 73 and the upper part of the sleeve 75, which are main parts of the sleeve, comprise a medium-gauge knitting, and therefore, the tension is adjusted to the medium level. The vicinity of the elbow joint 74 at the middle of the end part of the sleeve 73 and the upper part of the sleeve 75 comprises a low-gauge knitting, and consequently, the tension of the knit fabric near the elbow joint is reduced, allowing the fabric to be stretched and contracted comparatively easily with a small force. The shoulder area 72 comprises a low-gauge knitting. Consequently, the tension is small and these areas can be stretched and contracted comparatively freely with a small force. The upper back area is not illustrated but is the same as the upper back 21 of FIG. 2. The breast area 77 comprises a medium-gauge knitting, and consequently, the tension is adjusted to the medium level, but in addition, the bust areas 78 in the breast area 77 comprise a low-gauge knitting, and the low-gauge knitting with good stretchability gives an attractive appearance to the bust without flattening the bust. It is preferable that in particular, the bust area 78 be knitted in ups and downs three-dimensionally taking account of the bust volume.

The underbust area 79 comprises a high-gauge knitting which provides strong tension. Thus it is firmly supported to prevent generation of wrinkles at the shoulders 72 and upper back area (not illustrated) by rising of the breast area 77.

The waist area 80 comprises a medium-gauge knitting. In FIG. 7, numeral 76 is the seam line which sews the sleeve 71 to the body.

Figure 8:
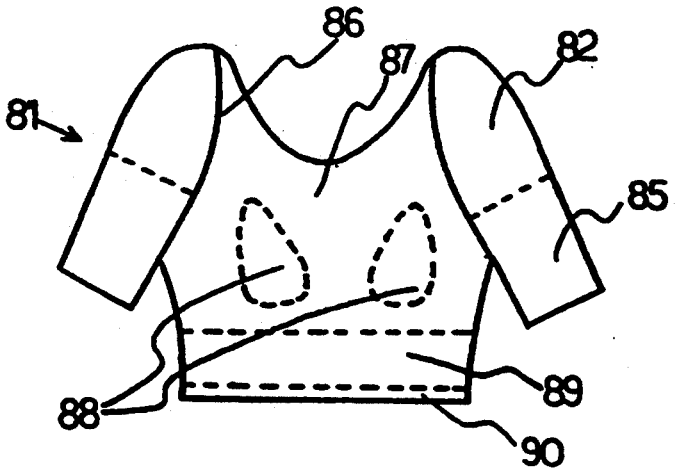
FIG. 8 is a schematic front view of a woman's short-sleeved undergarment with a short body length as one embodiment of the garments of the present invention.

FIG. 8 is similar to the woman's undergarment with the short body length as shown in FIG. 7, but is a schematic front view of a woman's short-sleeved undergarment for one embodiment of the garments of the present invention. This underwear also comprises the stretchable knitted fabric such as a circular knitted fabric.

In FIG. 8, numeral 81 is a sleeve, and in this embodiment, the end part of the sleeve 85 comprises a medium-gauge knitting, and therefore, the tension is adjusted to the medium level. The shoulder area 82 comprises a low-gauge knitting, and consequently, tension is small and these areas can be stretched and contracted comparatively freely with a small force. The upper back area is not illustrated but is the same as the upper back 21 of FIG. 2. The breast area 87 comprises a medium-gauge knitting, and consequently, the tension is adjusted to the medium level, but in addition, the bust areas 88 in the breast area 87 comprise a low-gauge knitting, and the low-gauge knitting with good stretchability gives an attractive appearance to the bust without flattening the bust. It is preferable that in particular, the bust area 88 be knitted in ups and downs three-dimensionally taking account of the bust volume.

The underbust area 89 comprises a high-gauge knitting which provides strong tension. Thus it is firmly supported to prevent generation of wrinkles at the shoulders 82 and upper back area (not illustrated) by rising of the breast area 87.

The waist area 90 comprises a medium-gauge knitting. In FIG. 8, numeral 86 is the seam line which sews the sleeve 81 to the body.

Figure 9:
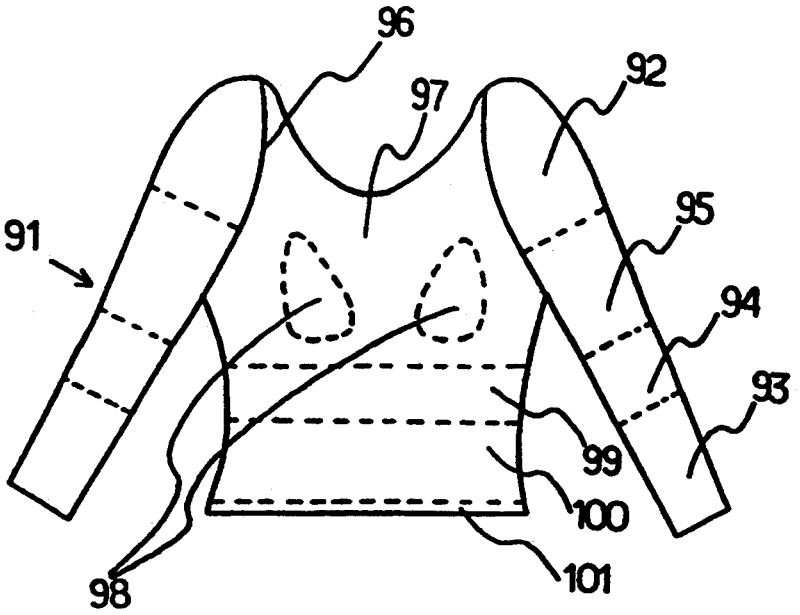
FIG. 9 is a schematic front view of a woman's long-sleeved undergarment with an ordinary body length as one embodiment of the garments of the present invention.

FIG. 9 is a schematic front view of a woman's long-sleeved undergarment with an ordinary body length for one embodiment of the garments of the present invention. This undergarment also comprises a stretchable knit fabric such as the circular knitted fabric.

In FIG. 9, numeral 91 is a sleeve, and in this example, the end part of the sleeve 93 and the upper part of the sleeve 95, which are main parts of the sleeve, comprise a medium-gauge knitting, and therefore, the tension is adjusted to the medium level. The vicinity of the elbow joint 94 at the middle of the end part of the sleeve 93 and the upper part of the sleeve 95 comprises a low-gauge knitting, and consequently, the tension of the knit fabric near the elbow joint is reduced, allowing the fabric to be stretched and contracted comparatively easily with a small force. The shoulder area 92 comprises a low-gauge knitting, and consequently, the tension is small and these areas can be stretched and contracted comparatively freely with a small force. The upper back area is not illustrated but is the same as the upper back 21 of FIG. 2. The breast area 97 comprises a medium-gauge knitting, and consequently, the tension is adjusted to the medium level, but in addition, the bust areas 98 in the breast area 97 comprise a low-gauge knitting, and low-gauge knitting with good stretchability gives an attractive appearance to the bust without flattening the bust. It is preferable that in particular, the bust area 98 be knitted in ups and downs three-dimensionally taking account of the bust volume.

The underbust area 99 comprises a high-gauge knitting which provides strong tension. Thus it is firmly supported to prevent generation of wrinkles at the shoulders 92 and upper back area (not illustrated) by rising of the breast area 97.

The waist area 100 comprises a medium-gauge knitting. In addition, the abdomen area and the area covering the upper hip portion on the rear side 101 comprise a high-gauge knitting to prevent generation of wrinkles from the rising of these areas.

In FIG. 9, numeral 96 is the seam line which sews the sleeve 91 to the body.

Figure 10:
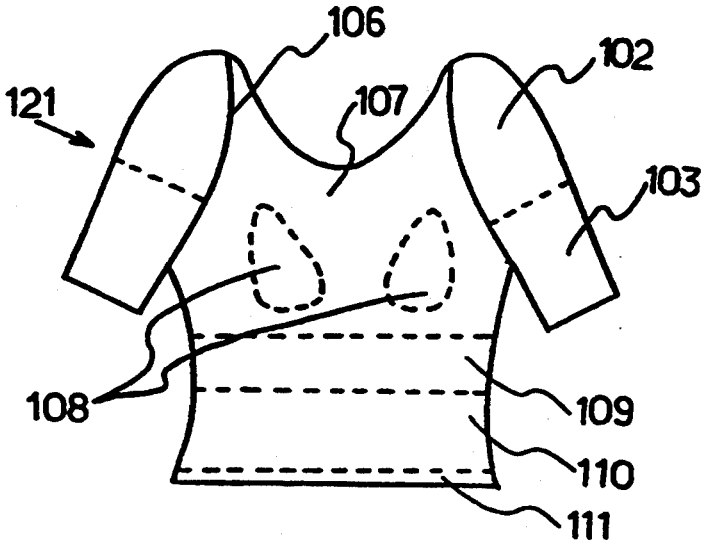
FIG. 10 is a schematic front view of a woman's short-sleeved undergarment with an ordinary body length as one embodiment of the garments of the present invention.

FIG. 10 is a schematic front view of a woman's short-sleeved undergarment with an ordinary body length for one embodiment of the garments of the present invention. This undergarment also comprises a stretchable knitted fabric such as the circular knitted fabric.

In FIG. 10, numeral 121 is a sleeve, and in this embodiment, the end part of the sleeve 103 comprises a medium-gauge knitting, and therefore, the tension is adjusted to the medium level. The shoulder area 102 comprises a low-gauge knitting, and consequently, tension is small and the area can be stretched and contracted comparatively freely with a small force. The upper back area is not illustrated but is the same as the upper back 21 of FIG. 2. The breast area 107 comprises a medium-gauge knitting, and consequently, the tension is adjusted to the medium level, but in addition, the bust areas 108 in the breast area 107 comprise a low-gauge knitting, and low-gauge knitting with good stretchability gives an attractive appearance to the bust without flattening the bust. It is preferable that in particular, the bust area 108 be knitted in ups and downs three-dimensionally taking account of the bust volume.

The underbust area 109 comprises a high-gauge knitting which provides strong tension. Thus it is firmly supported to prevent generation of wrinkles at the shoulders 102 and upper back area (not illustrated) by rising of the breast area 107.

The waist area 110 comprises a medium-gauge knitting. In addition, the abdomen area and the area covering the upper hip portion on the rear side 111 comprises a high-gauge knitting to prevent generation of wrinkles due to the rising of these areas.

In FIG. 10, numeral 106 is the seam line which sews the sleeve 121 to the body.

Needless to say, the embodiments of the garments of long-sleeved and short-sleeved types without groin piece as shown in FIGS. 7 through 10 are applicable to the garments shown in FIGS. 4 through 6.

While this invention has been described with reference to a small number of specific examples of woman's undergarment, the application shall not be limited only to those but the invention can be applied to various garments made of stretchable knitted fabric with sleeves, such as other daywears, leotards, sportswear, blouses, coats, blousons, jumpers, and the like.

The fibers used for the stretchable knitted fabric are not particularly limited, but various synthetic fibers, artificial fibers and natural fibers which have been popularly employed to produce such stretchable knitted fabric are adopted. Examples of the fibers include polyamide fibers, polyester fibers, polyolefine fibers, acrylic fibers, vinylon fibers, polyurethane elastomer fibers, rayon, acetate fibers, animal hair fibers, silk, cotton, or other various types of synthethic fibers, artificial fibers, natural fibers and mixtures thereof. In particular, it is preferable to use elastomer fibers such as polyurethane elastomer fibers, etc. in combination with ordinary synthetic fibers or artificial fibers or natural fibers, and it is recommended to select a proper type of fibers depending on the knitted fabric and the type of garments.

This is not intended to restrict the invention to a specific example but it is preferred to use paralleled yarn comprising both of ordinary synthetic fibers or artificial fibers or natural fibers having a cotton yarn count from 100 to 20 at conversion in mono-yarn and elastomer fiber yarn of 10–100 d (denier) represented by polyurethane elastomer fibers when making yarns. In particular, a covered yarn in which polyurethane elastomer fibers are used as a core yarn, around which another fiber such as cotton yarn covers a core yarn is preferably used.

Any kind of the stretchable knitted fabric can be used unless it particularly interferes with the purposes of the present invention.

Examples of stretchable knitted fabric include raschel fabric, plain circular fabric, rib knit, or tricot, but the invention shall not be limited to these. Among them, the stretchable knitted fabric of a circular knitted fabric type is particularly preferable.

The gauge (density) is not particularly limited, but to explain it in the wale with the number of yarns per inch, for one example, high-gauge knitting is designed to be about 49–52 yarns/inch, medium-gauge knitting is designed to be about 47–50 yarns/inch and low-gauge knitting is designed to be about 44–48 yarns/inch. However, even if the wale is designed to have the above gauge range, the boundary area where the gauge is changed, for example, the vicinity of the boundary region between the high-gauge knitting and the medium-gauge knitting, is influenced by both gauges and cannot achieve the gauge in the range described above, but this is justifiable.

EXAMPLE 1

To the command input unit of a commercially available plain stitch circular knitting machine, commands for the gauge pattern as shown in FIG. 3 were inputted and paralleled yarn comprising both of 40-d nylon fiber yarn and 30 d/60 d core spun yarn (CSY) formed with polyurethane elastomer fiber yarn as a core yarn and cotton yarn as a covering yarn were used, and knitted fabrics shown in (a), (b), (c) of FIG. 3 were produced with the aforementioned plain stitch circular knitting machine. The fabrics were cut into patterns of bodies, and right and left sleeves, respectively, and the specified portions described in the aforementioned FIG. 3 were sewn, and the woman's undergarment shown in FIGS. 1 and 2 were prepared. The size is M (medium size: Table 15 of JIS L 4005), which is a popular medium size among Japanese women.

The gauge was 52 yarns/inch as the designed value for the high-gauge knitting in terms of wale, 49 yarns/inch for the medium-gauge knitting, and 47 yarns/inch for the low-gauge knitting.

The garments obtained was worn by a woman tester whose sizes were 82 cm for the bust and 91 cm for the hip, equivalent to the physical dimensions of size M. She was asked to bend forward until her both hands reached the ground from the upright position, then lean backward, and stretch both hands straight upwards from the upright position to stand on tiptoe, and repeat this motion five times.

Thereafter, the undergarment was checked for wrinkle generation and sleeve displacement condition. Any new wrinkle generation was scarcely recognized and rising (upward displacement) of the sleeves was as small as about 1 cm. Rising of the side edge of the legholes was hardly observed. The wearer did not complain of any particular wear discomfort but expressed generally favorable wear comfort.

Figure 11:
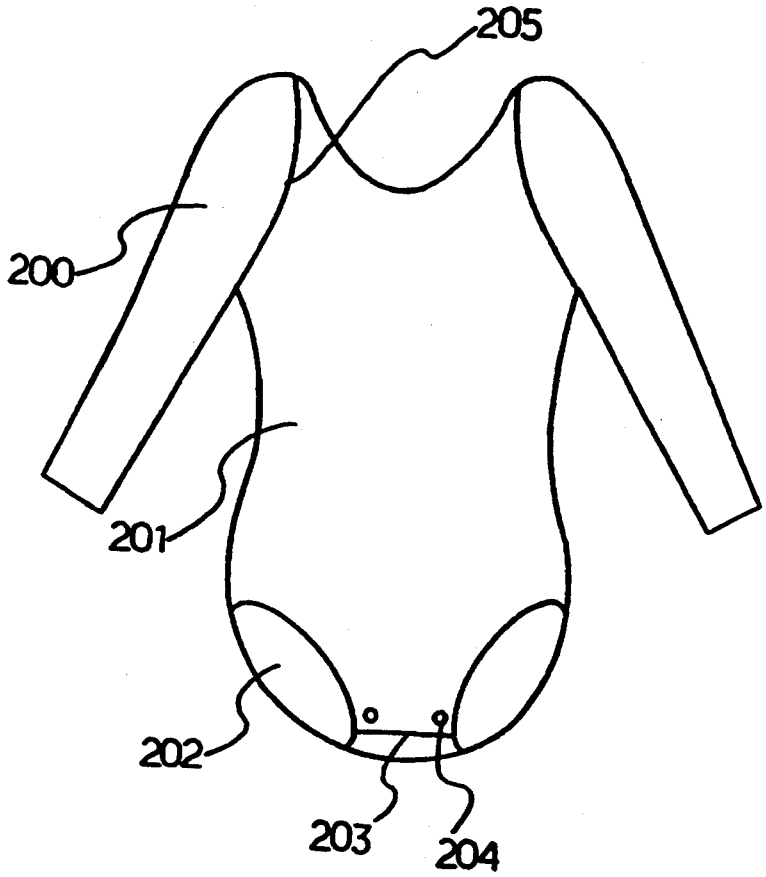
FIG. 11 (PRIOR ART)
FIG. 11 is a schematic front view of a conventional woman's long-sleeved underwear with the groin piece.

The conventional undergarment of size M as shown in FIG. 11 was produced using the similar fibers, and it was worn by the same woman. After the similar exercise was done, wrinkle-generation and other similar matters were observed in the similar manner. The cuff area of the sleeve had risen upward about 10 cm and many large wrinkles were generated at the sleeves, shoulders and upper back area. The side edges at the legholes had risen about 2 cm upward, thus wear comfort was greatly degraded.

For reference, to determine how much pressure was applied to the body, pressure was measured on each part of the garments of the present invention and the conventional garments prepared as above.

The above garments were put on over manikins of size M (medium size), and a strain gauge type pressure sensor (the strain gauge type pressure sensor "PS-2K" of KYOWA DENGYO Inc.) was placed between the garments and the manikin at the pressure measuring portion, and the output from the strain gauge type pressure sensor was measured by the dynamic strain indicator (the dynamic strain indicator "BPM-611A" of KYOWA DENGYO Inc.). Measurements were taken three times for each measuring portion and the mean value was obtained.

The pressure measurements results were 74.7 g/cm$^2$ for the top bust area, 19.7 g/cm$^2$ for the underbust area, 9.3 g/cm$^2$ for the waist area, 55.7 g/cm$^2$ for the abdomen area, 13.3 g/cm$^2$ for the acromion area (which is a peak of the shoulder), and 62.7 g/cm$^2$ for the vicinity of bulge of hip in the case of the garments of the present invention. In the case of the above-mentioned conventional garments, the pressure measurements results were 454.0 g/cm$^2$ for the top bust area, 8.3 g/cm$^2$ for the underbust area, 20.7 g/cm$^2$ for the waist area, 82.7 g/cm$^2$ for the abdomen area, 38.7 g/cm$^2$ for the acromion area (a peak of the shoulder), and 160.7 g/cm$^2$ for the vicinity of bulge of hip.

As clear from the comparison of these measured values, in the case of the garments of the present invention, pressure at the underbust area is higher than that at the underbust area of the conventional garment sample. This means that the garments are firmly fitted and held to the body at this position and that the garments of the present invention are less susceptible to rising or sliding up due to physical motion. In the case of the garments of the present invention, the pressure at the shoulder area is smaller than that at the shoulder area of the conventional garments. This means that satisfactory flexibility in response to physical motion of the human body is achieved because of the small pressure at the shoulder area. In addition, in the case of the garments of the present invention, pressure at the top bust portion is significantly smaller than that at the top bust area of the conventional garments. This means that the bust profile is held to provide a more attractive appearance without flattening the shape of the bust. In the case of the garments of the present invention, pressure near the bulge of hip is significantly smaller than that near the bulge of hip of the conventional garments. This means that the fabric at this portion is easy to stretch and profile of the two bulge portions of the hip are beautifully reproduced and held in a natural profile.

Effect of the Invention

The present invention can provide garments which are free from cramping at the shoulders and upper back areas, are scarcely rised or slided up during wearing of the garments, have less wrinkles generated by the motion of a human body, and provide excellent flexibility to the motion of a human body and satisfactory wear comfort.

In the garments of the present invention, according to a preferred embodiment in which the breast area comprises the medium-gauge knitting and the bust areas in the breast area comprises the low-gauge knitting, the shape of the breast area is adjusted with proper tension provided by the medium-gauge knitting and an attractive bust line is attained without flattening the bulge of the bust area.

In the garments of the present invention, according to the preferred embodiment in which the garments with sleeves made of the stretchable knitted fabric are long-sleeved garments and the vicinities of the elbow joints are formed by the low-gauge knitting, the better flexibility against bending of elbow joints and reduced rising of sleeves and reduced wrinkle generation are attained.

In the garments of the present invention, according to a preferable embodiment in which the waist area is formed by the medium-gauge knitting, a comfortable fitting feeling with the proper supporting force at the waist area is attained, rising upward of the waist area is prevented, wrinkle generation is reduced, and garments with good wear comfort free of strong squeezing at the waist area are provided.

In the garments of the present invention, according to a preferable embodiment in which the garments with sleeves made of stretchable knitted fabric are garments with abdomen and hip areas formed continuously integral with the body area and the above-mentioned abdomen and hip areas comprise the high-gauge knitting with relatively high density, rising upward of side edges of legholes are prevented so that reduction of wear comfort is prevented, swelling out of superflous flesh is suppressed in the abdomen region, and garments with which an attractive physical appearance can be given are provided.

In the garments of the present invention, according to a preferable embodiment in which the vicinity of the bulge of the hip is formed by the low-gauge knitting with relatively low density, the two top round parts of hip are not flattened but are rounded into a natural profile in the vicinity of the bulge of hip.

In the garments of the present invention, according to a preferable embodiment in which one of the sleeves, one of shoulder and one of upper back areas are formed with integrated continuous one fabric, it enables the fabric to display better capabilities to follow stretching and contraction in the direction of motion more easily with small stress caused by the low-gauge knitting at the shoulders and upper back areas, and can provide garments which can prevent wrinkle generation or rising of sleeves more effectively.

In the garments of the present invention, according to a preferable embodiment in which the stretchable knitted fabric is the circular knitted fabric, the seam parts can be reduced and the gauge of the circular knitted fabric can be easily adjustable to a desired level, thereby suppressing an increase of costs.

In the garments of the present invention, according to a preferable embodiment in which the stretchable knitted fabric comprises fibers containing elastomer fibers, the fabric display more suitable tension and garments with excellent wear comfort can be provided.

What is claimed is:

1. A garment comprising a stretchable knitted fabric, the garment comprising:

sleeves provided with a cuff area;

a breast area;

an underbust area;

shoulder areas; and an upper back area;

wherein the underbust area comprises a high-gauge knitting with relatively high density, the shoulder and upper back areas comprise a low-gauge knitting with relatively low density and the cuff areas comprise a medium-gauge knitting with relatively medium density.

2. A garment according to claim 1, wherein the breast area of the garment comprises a medium-gauge knitting with relatively medium density, the garment further comprising bust areas in the breast area which comprise a low-gauge knitting with relatively low density.

3. A garment according to claim 1, wherein the sleeves of the garment are long sleeves, and have elbow areas which comprise a low-gauge knitting with relatively low density.

4. A garment according to claim 1, further comprising a waist area which comprises a medium-gauge knitting with relatively medium density.

5. A garment according to claim 1, wherein the garment further comprises continuously integral abdomen and hip areas, the abdomen and hip areas comprising a high-gauge knitting with relatively high density.

6. A garment according to claim 5, wherein the hip area comprises a low-gauge knitting with relatively low density in the vicinity of bulge area of the hip area.

7. A garment according to claim 1, wherein one of the sleeves, one of the shoulders areas and one of the upper back areas are formed from a continuous fabric.

8. A garment according to claim 1, wherein the stretchable knitted fabric is a circular knitted fabric.

9. A garment according to claim 1, wherein the stretchable knitted fabric comprises fibers containing elastomer fibers.

* * * * *